US005356675A

United States Patent [19]

Unger et al.

[11] Patent Number: 5,356,675

[45] Date of Patent: Oct. 18, 1994

[54] GLAZING SYSTEM

[76] Inventors: Frederick C. Unger, 179 Bayview Ave., Berkley, Mass. 02779; Ronald M. Hays, 232 Ryerson Rd., Warwick, N.Y. 10990

[21] Appl. No.: 997,690

[22] Filed: Dec. 28, 1992

[51] Int. Cl.[5] ..... B32B 9/00

[52] U.S. Cl. ..... 428/34; 428/33; 428/99; 52/823; 52/824; 52/784; 52/787; 52/821; 52/822

[58] Field of Search ..... 428/34, 99, 35, 33; 52/823, 824, 782, 784, 787, 788, 822, 474, 475, 826

[56] References Cited

U.S. PATENT DOCUMENTS

| | | | |
|---|---|---|---|
| 3,479,768 | 11/1969 | Smadja | 52/788 |
| 4,539,243 | 9/1985 | Miller | 428/34 |
| 4,608,796 | 9/1986 | Shea, Jr. | 52/788 |
| 4,926,594 | 5/1990 | Sampson et al. | 52/200 |

FOREIGN PATENT DOCUMENTS

| | | | |
|---|---|---|---|
| 8706291 | 10/1987 | European Pat. Off. | 52/788 |

OTHER PUBLICATIONS

Grant and Hackh's Chemical Dictionary, 1987, p. 201.
Websters II, New Riverside Dictionary, 1989 p. 484.
Abundant Energy Inc.—Pro-Seal Brochure.
Traco—Window Design Brochure.
NSM: UGS Universal Glazing System.
BDG North America, Ltd. System.
Sierra Sunroom.

*Primary Examiner*—Patrick J. Ryan
*Assistant Examiner*—Patrick R. Jewik
*Attorney, Agent, or Firm*—Salter & Michaelson

[57] ABSTRACT

A glass panel assembly includes at least one elastomeric base plate which is received on a supporting frame structure, at least one elongated rigid attachment element received on the base plate for attaching it to the frame structure, at least one glass panel received on the base plate so that it is supported thereon and at least one pressure plate received on the glass panel and secured to the attachment element for securing the glass panel in the assembly. The assembly is adapted to compensate for dimensional irregularities and different angular planes in the supporting frame structure as well as differences in the thermal expansion properties of the various components in the assembly and the support frame structure. The assembly is further adapted to minimize thermally conductive paths between interior and exterior assembly components in order to minimize condensation on interior components, and the one or more base plates of the assembly include gutters for removing moisture from the assembly.

18 Claims, 3 Drawing Sheets

GLAZING SYSTEM

BACKGROUND AND SUMMARY OF THE INVENTION

The instant invention relates to glazing systems and more particularly to a glass panel assembly for use on a vertical or inclined supporting frame structure.

The concept of incorporating large glass panel assemblies into various buildings, including dwellings and commercial buildings has gained significant popularity in recent years. Further, this increase in popularity has extended to both the use of large single glass panel assemblies to form skylights and large windows as well as to the use of multiple glass panel assemblies to form large vertical or inclined glass wall areas in conservatories and sunrooms, atriums, etc. However, while building elements which incorporate large glass panel assemblies have become extremely popular, it has been found that they are often among the most difficult and expensive building elements to construct. One of the primary reasons for this is that it is generally very difficult to compensate for the large differences in the thermal expansion properties of the various types wood, metal, rubber, and glass commonly utilized to construct and support glass panel assemblies. Specifically, it has been found that because of the differences in the thermal expansion properties of these materials it can be extremely difficult to form tightly sealed waterproof glass panel assemblies, particularly when they are supported on building frame structures made of wood or wood composites.

It has also been found that the inaccuracies which are inherent in virtually all wooden frame structures make it even more difficult to provide well sealed glass panel assemblies over wooden frame structures. In this regard, even wooden frame structures constructed by the most skillful craftsman always have some inaccuracies, and these inaccuracies are frequently amplified by the warping, expansion and contraction which occurs to some extent with even the most dimensionally stable woods.

Even still further, it has been found that when constructing glass panel assemblies on frame structures of various materials, the thermal conductivity between exterior and interior assembly components can often cause condensation to be formed on the interior components. In this regard, it has been found that whenever there are direct thermally conductive paths which cause thermal bridging between interior and exterior mounting components, the interior components are generally prone to developing condensation, and even frost, during periods of cold weather. As a result, it has been found that it is important to eliminate thermally conductive paths whenever possible, although it is generally still necessary to provide some means for dissipating moisture from interior mounting components in order to avoid water damage from condensation or leakage to adjacent wood or metal framing. It has also been found that it is important to dissipate water near insulated glass edge seals because prolonged exposure to water can cause seal failures and fogging within insulated glass units.

The instant invention provides an effective glass panel assembly which overcomes the disadvantages of the heretofore available assemblies. Specifically, the glass panel assembly of the instant invention is adapted to compensate for variations in the thermal expansion properties of different construction materials, including glass, metal, wood and rubber and to avoid direct thermal paths between interior and exterior mounting components made of thermally conductive metals. The glass panel assembly of the instant invention further provides an effective network of channels and gutters for conducting water from condensation or leakage to appropriate drainage areas. Even still further, the instant invention provides a glass panel assembly which includes a base plate comprising elevated pads for supporting an insulated glass panel so that the edge seal thereof is normally out of direct contact with standing water. Still further, the glass panel assembly is adapted to compensate for minor irregularities and imperfections in the construction of frame structures on which it is mounted.

More specifically, the glass panel assembly of the instant invention is adapted to be mounted on a supporting frame structure including one or more support elements, and it comprises an elongated base plate made of an elastomeric material which is received on a support element of the support structure. The base plate includes a base portion, a center attachment portion extending upwardly from the base portion and a support pad portion extending upwardly from the base portion in outwardly spaced relation to the attachment portion. The base plate preferably includes a pair support pad portions which extend upwardly from the base portion in outwardly spaced relation on opposite sides of the attachment portion, and it preferably further comprises a channel element which extends upwardly from the base portion in outwardly spaced relation to at least one of the support pad portions for defining one or more moisture channels on the base plate. The attachment portion and the support pad portions preferably also cooperate to define moisture channels therebetween. The glass panel assembly further comprises an elongated ridged attachment element received in coextensive relation on the attachment portion of the base plate and secured to a frame element beneath the base plate with fastening elements which extend through the attachment portion of the base plate. The assembly further includes a glass panel received and supported on at least one of the support pad portions so that an edge of the glass panel is spaced inwardly slightly from the support pad portion thereof and spaced outward slightly from the adjacent attachment element. Further, the glass panel assembly includes an elongated pressure cap comprising an aluminum frame member having a pressure pad made of elastomeric material thereon which is received in engagement with the glass panel so that the glass panel is captured between the pressure pad and the support pad portion of the base plate. The pressure cap is secured to the attachment element with screws or the like which engage the attachment element to retain the pressure cap in position on the glass panel. Specifically, the attachment element preferably includes a pair of spaced upstanding wall portions which cooperate to define a channel therebetween and which have inwardly facing longitudinally extending grooves thereon for receiving fastening elements in threaded engagement in the attachment element. The attachment element preferably further comprises a pair of flanges which extend outwardly from the upstanding wall portions thereof for supporting the attachment element on the attachment portion of the base plate and for stabilizing the attachment element against tilting out of alignment. The glass panel assembly of the instant invention can be effectively embodied as comprising a single glass panel or as comprising a plurality of glass panels. In the latter case, the glass panel assembly is normally assembled on a frame assembly comprising a plurality of rafters and purlins, and the assembly normally includes a base plate mounted on each of the rafters and each of the purlins. Further, the base plates are oriented so that the moisture channels in the base plates on the purlins communicate with the moisture channels in the base plates on the rafters so that water from the moisture channels in the base plates on the purlins is conducted to the moisture channels in the base plates on the rafters where it is carried to the perimeter of the glass panel assembly and weeped to the exterior of the assembly. A multi-panel assembly of this type further normally includes an attachment element on each of the base plates, means for securing each of the attachment elements to the respective purlin or rafter thereof, and a plurality of glass panels which are supported on the support pad portions of the base plates to form an enlarged assembly comprising a plurality of glass panels. The assembly further comprises a plurality of pressure caps which are secured to the attachment elements for retaining the glass panels in assembled relation on the respective base plates thereof.

Accordingly, it is a primary object of the instant invention to provide an effective glass panel assembly comprising an elastomeric base plate which is receivable on a rafter or purlin and adapted for supporting a glass panel thereon.

Another object of the instant invention is to provide an effective glass panel assembly comprising a plurality of elastomeric base plates having moisture channels therein for carrying moisture to the exterior of the assembly by gravitational flow.

Another object of the instant invention is to provide an effective glass panel assembly comprising one or more elongated ridged metal exterior pressure caps which are thermally isolated from the interior components of the assembly.

An even still further object of the instant invention is to provide an effective glass panel assembly which is adapted to compensate for minor irregularities or imperfections in a supporting frame structure on which the glass panel assembly is mounted.

And even still further object of the instant invention is to provide an effective glass panel assembly which is capable of compensating for variations in the thermal expansion properties of the various components thereof.

An even further object is to provide a glass panel assembly which includes an elastomeric base plate and an elongated attachment element which is receivable in engagement in a channel in the base plate to stabilize the assembly and straighten the base plate.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
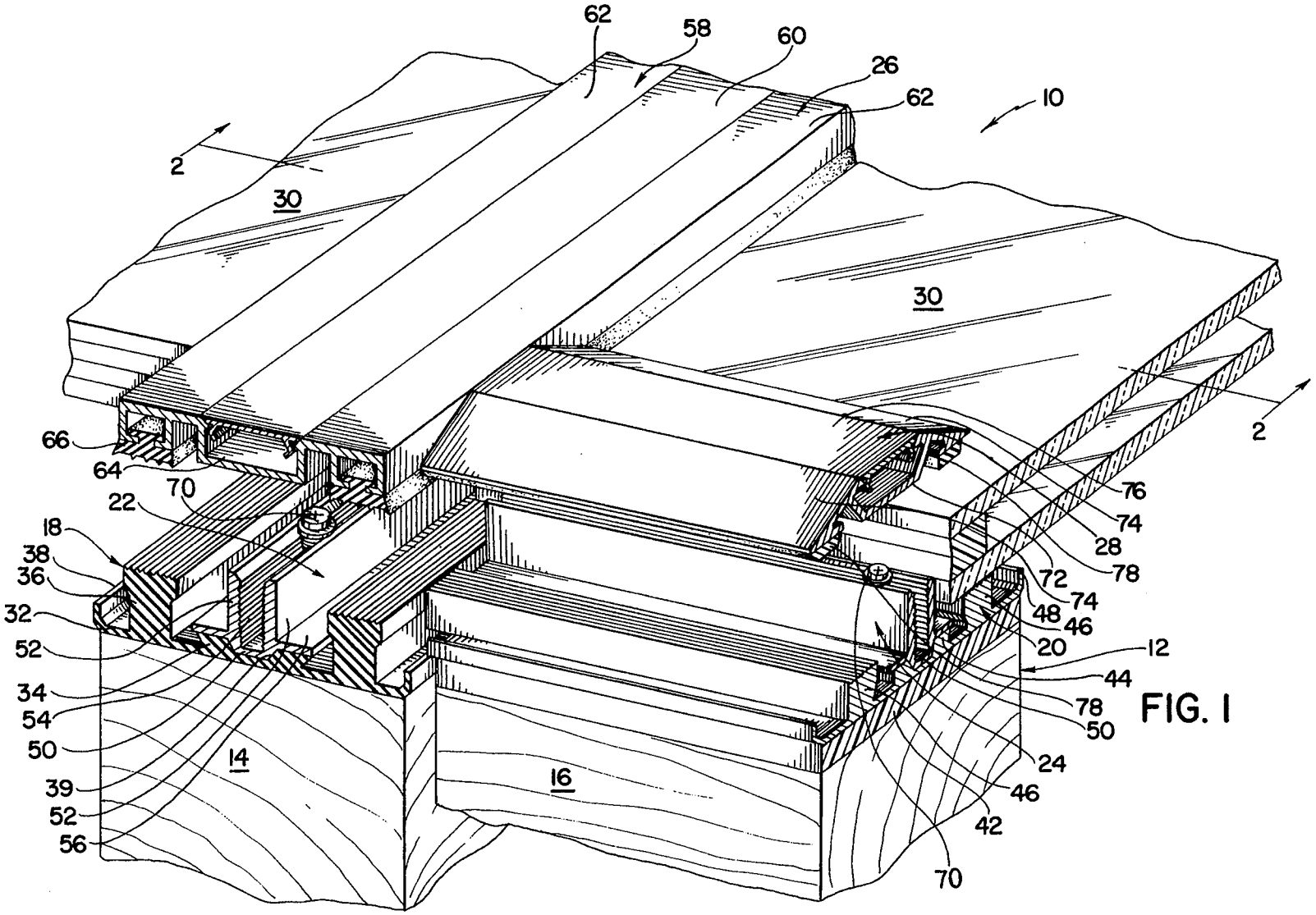
FIG. 1 is a fragmentary perspective view of the glass panel assembly of the instant invention.
Figure 3:
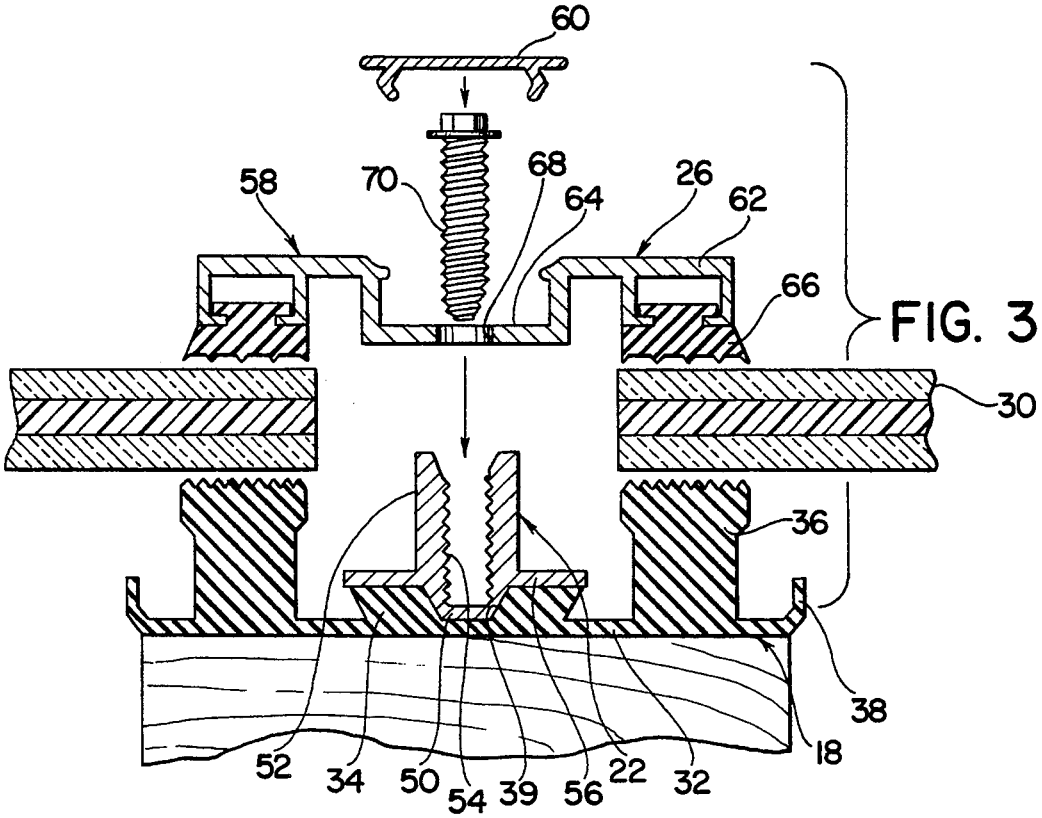
FIG. 3 is a corresponding exploded cross-sectional view thereof.
Figure 2:
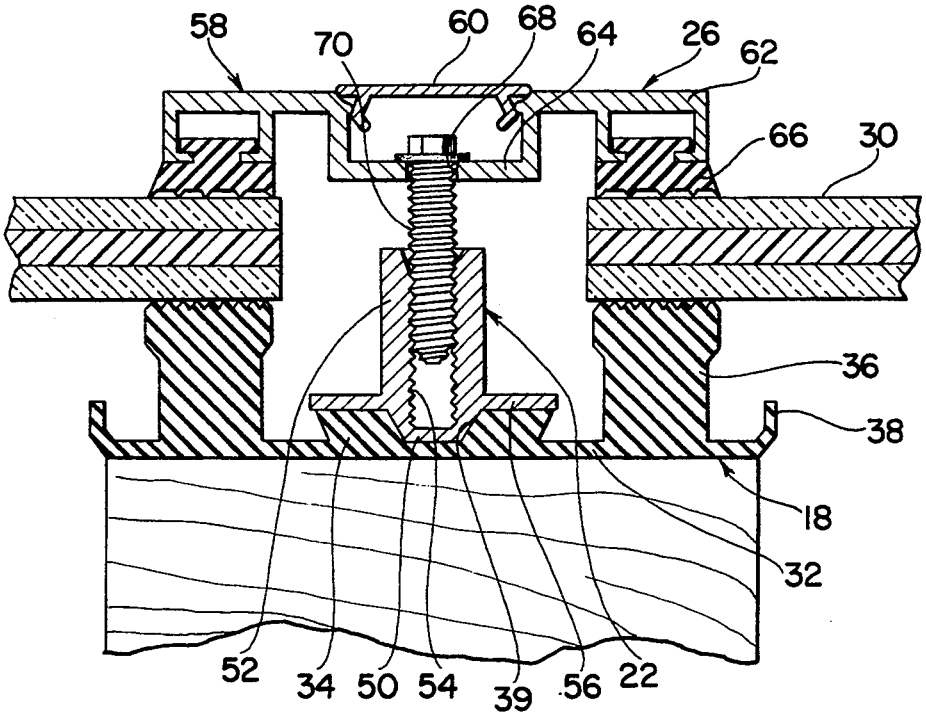
FIG. 2 is a cross-sectional view thereof taken along line 2—2 in FIG. 1.

Referring now to the drawings, the glass panel assembly of the instant invention is illustrated and generally indicated at 10 in FIG. 1. The glass panel assembly 10 is adapted to be assembled and supported on a frame structure generally indicated at 12 comprising one or more rafters 14 and one or more purlins 16 which extend between the rafters 14 in substantially perpendicular relation thereto. The glass panel assembly 10 comprises first and second base plates generally indicated at 18 and 20, respectively, first and second fastening elements generally indicated at 22 and 24, respectively, and first and second pressure cap assemblies generally indicated at 26 and 28, respectively. The glass panel assembly 10 further comprises a plurality of glass panels 30 which are assembled and secured to the frame structure 12 with the base plates 18 and 20, the attaching elements 22 and 24 and the pressure caps 26 and 28.

The frame structure 12 is normally constructed from a dimensionally stable kiln dried lumber stock such redwood, cedar, mahogany or laminated wood, although the glass panel assembly 10 can also be assembled on frame structures made of metals, such as aluminum or steel. In any event, the rafters 14 and purlins 16 preferably have upper bearing surfaces of at least approximately three inches in width. Further, the rafters 14 and the purlins 16 in the frame structure 12 are preferably constructed and assembled to relatively close tolerances to provide a frame structure having frame sections which correspond in dimension and configuration to the glass panels 30.

The base plates 18 and 20 are preferably extruded from a resilient elastomeric material, such as EPDM rubber. The base plate 18 comprises a main or base portion 32, a center attachment portion 34, a pair of support pad portions 36 and a pair of outer channel portions 38. The main portion 32 is adapted to be received on the upper supporting surface of a rafter, such as the rafter 14, and the central attachment portion 34 is adapted for receiving and supporting the attachment element 22 thereon. Further, the central attachment portion 34 has a central longitudinally extending channel or recess 39 formed therein for receiving the attachment element 22 in interfitting engagement in order to more easily and effectively maintain the attachment element 22 in proper orientation on the attachment portion 34. The support pad portions 36 extend upwardly from the base portion 32 terminating and serrated upper surfaces which are adapted for receiving the panels 30 in sealing engagement therewith. The support pad portions 36, which are made from an elastomeric material, are flexible to enable them to support glass panels in angular dispositions thereon, such as in hip, valley or corner areas. The support pad portions 36 cooperate with the attachment portion 34 for defining moisture channels or gutters on opposite sides of the attachment portion 34, and the channel elements 38 extend upwardly in outwardly spaced relation to the support pad portions 36 for defining moisture gutters or channels on the outer sides of the support pad portions 36. In this regard, as will be seen, when an attachment element 22 is secured in the attachment portion 34 of one of the base plates 18 or 20 with screws or other fastening elements which extend through the base plate 18 or 20, the screws or other fastening elements are isolated from the moisture channels on the opposite sides of the attachment portion 34.

The base plate 20 is similar in construction to the base plate 18, and it includes a main or base portion 40 which is adapted to be supported on the beam 16. However, as illustrated, in order to elevate the base plate 20 relative to the base plate 18, the base portion 40 is supported on a spacer pad 42 so that moisture from the base plate 20 can drain into the adjacent moisture channel in the base plate 18. The base plate 20 further comprises an attachment portion 44, which is identical to the attachment portion 34, a pair of support pad portions 46, which are similar to the support pad portions 36 but of reduced height, and a pair of outer channel portions 48. The support pad portions 46 cooperate with the attachment portion 44 to define moisture channels or gutters on opposite sides of the attachment portion 44, and the outer channel portions 48 cooperate with the support pad portions 46 to define moisture channels or gutters on the opposite sides thereof from the attachment portion 44. The attachment portion 44 is essentially identical in configuration to the attachment portion 34, and it has an elongated longitudinally extending channel formed therein for receiving the attachment element 24 in interfitting engagement.

The attachment elements 22 and 24 are of essentially identical configuration, and each includes a downwardly extending center portion 50 which is adapted to be received in the channel of the respective attachment portion 34 or 44 thereof. Each of the attachment elements 22 and 24 further comprises a pair of spaced substantially parallel upstanding walls 52 having closely spaced, longitudinally extending, inwardly facing grooves formed therein which are adapted for receiving a threaded fastening element in threaded engagement therewith. Each of the attachment elements 22 and 24 further comprises a pair of outwardly extending flanges 56 which extend outwardly adjacent the lower ends of the walls 52 thereof for supporting the attachment elements 22 and 24 on their respective attachment portions 34 and 44. Each of the attachment elements 22 and 24 is adapted to be secured to the respective rafter 14 or purlin 16 thereof with screws or other fastening elements which extend through the center portions 50 thereof and the adjacent portions of the base plates 18 and 20 thereof and into the respective rafter 14 or purlin 16 thereof.

The pressure cap 26 is of conventional construction and it preferably includes a main portion generally indicated at 58 and a cap or channel cover 60. The main portion 58 includes a pair of side portions 62 and a center attachment channel portion 64. The side portions 62 are formed as elongated downwardly opening channels having reduced mouths or openings, as illustrated. The central portion 64 is preferably formed as an upwardly opening channel section having a plurality of openings 68 therein for securing the pressure plate 26 to the attachment element 22 thereof with a plurality of threaded screws 70 which are receivable in threaded engagement with the grooves 54 in the attachment element 22 thereof. The cap or cover 60 is receivable in interfitting engagement with the sides of the channel formed by the center portion 64 of the pressure cap 26 in order to retain the cover 60 in covering relation thereover. The pressure cap 26 further comprises a pair of elastomeric pressure pads 66 which are received in engagement in the downwardly opening channels formed in the side portions 62. The pressure pads 66 are preferably made of an elastomeric material, such as EPDM rubber, or elastomeric foam tape, and they are adapted to be received in sealing engagement with the glass panels 30 in order to secure the panels 30 in the glazing system 10. Further, the pressure pads 66 are positioned so that they are engageable with the glass panels 30 in generally opposed relation to the support pads 36 as illustrated.

The pressure cap 28 is also of conventional construction, and it is generally similar to the pressure cap 26. The pressure cap 28 comprises a center channel portion 72 and a pair of angular side portions 74. The pressure cap 28 further comprises an upper cap or cover portion 76 and a pair of elastomeric pressure pads 78. The center channel portion 72 has a plurality of apertures (not shown) formed therein for securing the pressure cap 28 to the attachment element 24 with screws 70 which are receivable in threaded engagement in the attachment element 24. When the pressure cap 28 is secured to the attachment element 24 in this manner, the pressure pads 78 are received in sealed engagement with a pair of the glass panels 30 to secure the glass panels 30 in the assembly 10. The upper cover or cap 76 is received in engagement with the channel portion 72 for enclosing the channel portion 72 and covering the screws 70.

The glass panels 30 preferably comprise either single pane or multipane insulated glass panels of conventional construction, and they are dimensioned and configured to be received on the appropriate support pads 36 or 46 in the manner illustrated. It will be understood, however, that the term glass panel as used herein is intended to encompass various other types of transparent or translucent panels, such as those made of various plastics, solid opaque panels, insulated panels, photovoltaic panels and various other flat surface materials.

Figure 4:
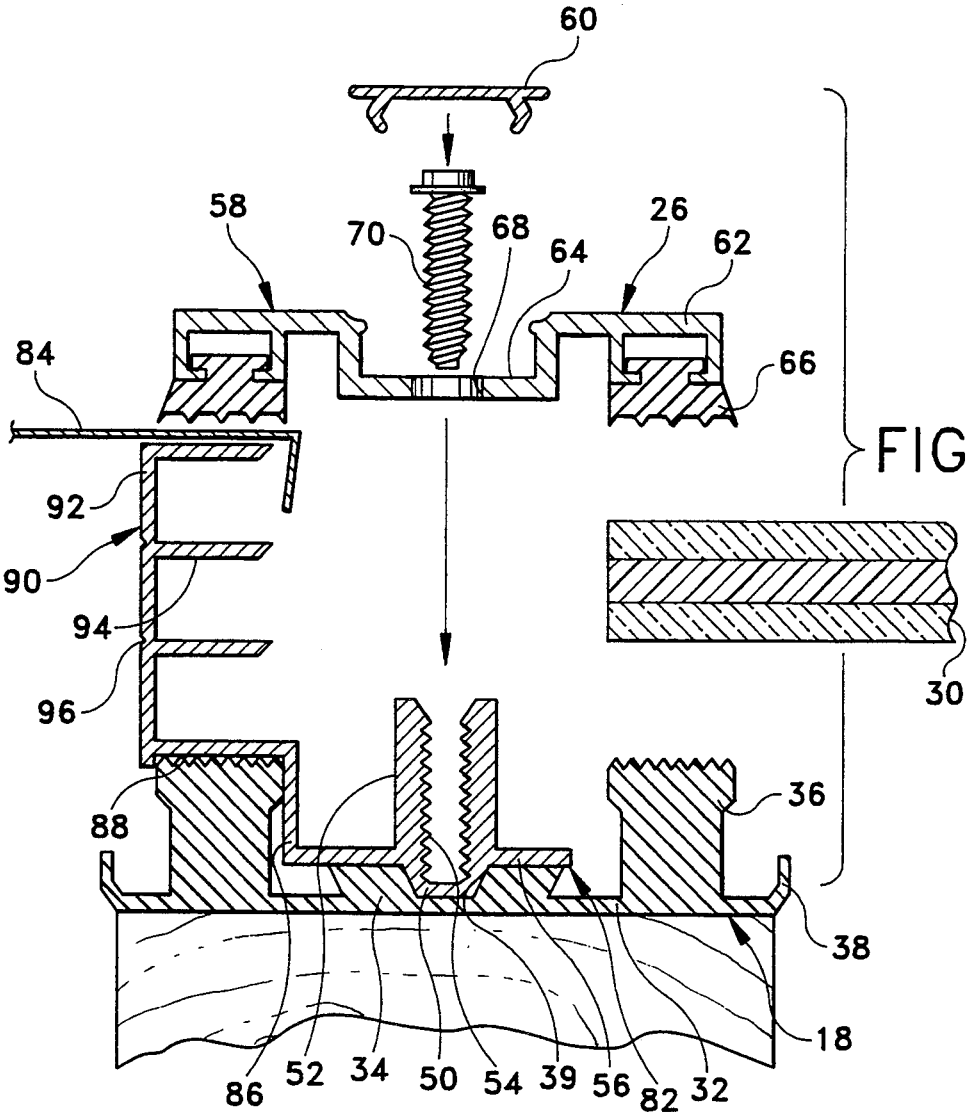
FIG. 4 is a cross-sectional view of a modified form of the glass panel assembly.

Referring now to FIG. 4, a slightly modified form of the glass panel assembly of the invention is illustrated and generally indicated at 80. The glass panel assembly 80 is adapted for use along the perimeter sections of a large multipane panel area, and it includes a base plate 18, a pressure cap 26 and a plurality of fastening elements 70. However, in contrast to the glass panel assembly 10, the assembly 80 includes a modified attachment element 82 which is adapted for supporting the pressure cap 26 thereof along the perimeter of a large panel area and for interfacing the panel area with a flashing 84 which seals to adjacent surfaces. The attachment element 82 includes wall portions 52, a center portion 50 and flanges 56. In addition, the attachment element 82 includes a lower portion 86 which extends outwardly and upwardly from one of the flanges 56 thereof and includes a lower support section 88 which rests on the upper surface of an adjacent support pad portion 36. The attachment element 82 further includes an upper portion 90 which includes a vertical section 92 and a plurality of horizontal upper support sections 94 which are disposed in substantially parallel relation to the lower support section 88. In this regard, the vertical section 92 is adapted to be cut to a predetermined height above the lower support section 88 at notches 96 for supporting the pressure cap 36 and for enabling the assembly 80 to be adapted to accommodate glass panels of various thickness. As illustrated, the assembly 80 is adapted to be assembled with flashing 84 so that the flashing 84 is received between one of the pressure pads 66 on the pressure cap 26 and the uppermost upper support section 94.

It is seen therefore that the instant invention provides an effective glass panel assembly for use in vertical or inclined glass wall sections. In this regard, the base plates 18 and 20 provide an effective network of moisture channels or gutters for conducting moisture from condensation or leakage away from the glass panel assembly 10 without causing damage to any of the components thereof or to the frame assembly 12. The pressure caps 26 and 28 are secured to the attachment elements 22 and 24, respectively, with screws 70 to minimize the thermally conductive paths therebetween. Further, the attachment elements 22 and 24 are actually isolated from the interior areas surrounding the glass panel assembly 10 by the support pads 36 and 46 which are made from a thermally nonconductive elastomeric material, and hence, the potential for developing significant amounts of condensation on the attachment elements 22 and 24 is virtually eliminated. Still further, because the base plates 18 and 20, including the pressure pads 36 and 46, respectively, thereon are made from a resilient elastomeric material, and because the attachment elements 22 and 24 are mounted on the base plates 18 and 20, the glazing system 10 is adapted to effectively compensate for minor dimensional irregularities or warping in the frame structure 12. Still further, because the glass panel assembly 10 relies on the support pads 36 and 46 and the pressure pads 66 and 78 to seal and retain the glass panels 30, the assembly 10 is effectively capable of compensating for variations in the thermal expansion properties of the various components thereof as well as of the support structure 12. Even still further, because the assembly 10 utilizes the support pads 66 and 78 to seal the glass panels 30 instead of hardening sealants, it is possible to readily replace one or more of the panels 30 without having to scrape hardened sealants from the various components of the assembly 10. In addition because the glass panel assembly can be adapted to interface with flashing 84 and to include attachment elements 82 which are designed for perimeter applications, the assembly has even greater versatility and effectiveness. Accordingly, it is seen that the glass panel assembly of the instant invention represents a significant improvement over the heretofore available glass panel assemblies which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A glass panel assembly for use on a supporting frame structure, the supporting frame structure comprising at least one elongated support element having a vertical or inclined support surface, said glass panel assembly comprising:

a) an elongated base plate made of a resilient elastomeric material, said base plate including a base portion which is adapted to be received on and supported by said support element so that said base portion extends longitudinally along the support surface thereof, said base plate further comprising an elongated longitudinally extending attachment portion extending upwardly from said base portion when said base portion is in an upwardly facing horizontal disposition and received on the support element, and an elongated longitudinally extending support pad portion extending upwardly from said base portion in spaced relation to said attachment portion when said base portion is in said horizontal disposition and received on the support element;

b) an elongated rigid longitudinally extending attachment element adapted to be received in coextensive relation on said attachment portion;

c) first fastening means for securing said attachment element to the support element through said base plate;

d) a glass panel adapted to be received and supported on said support pad portion, said glass panel having an edge and being adapted to be positioned so that said edge is in spaced relation to said attachment element on said base plate;

e) an elongated pressure cap including an elongated rigid cap portion and an elongated resilient pressure pad made of an elastomeric material on said cap portion, said pressure cap being adapted to be received in an assembled position on said glass panel so that said glass panel is captured between said pressure pad and said support pad portion; and f) second fastening means for securing said pressure cap to said attachment element so that said pressure cap is maintained in the assembled position thereof with said pressure pad in pressurized engagement with said glass panel adjacent said edge.

2. In the glass panel assembly of claim 1, said support pad portion and said attachment portion defining a first moisture channel therebetween on said base portion.

3. In the glass panel assembly of claim 2, said base plate further comprising channel means cooperating with said support pad portion for defining a second moisture channel on said base portion on the opposite side of said support pad portion from said attachment portion.

4. In the glass panel assembly of claim 1, said base plate further comprising a pair of said support pad portions, said support pad portions being disposed on opposite sides of said attachment portion, said glass panel assembly further comprising a pair of said glass panels, each of said glass panels being supported by one of said support pad portions on said base plate so that the edge of each glasspanel is in spaced relation to said attachment element, said pressure cap further comprising a pair of said pressure pads, each of said glass panels being captured between one of said support pad portions and one of said pressure pads when said pressure cap is in the assembled position.

5. In the glass panel assembly of claim 1, said attachment element and said attachment portion being received in interfitting engagement for maintaining said attachment element in position on said attachment portion.

6. In the glass panel assembly of claim 4, said base plate further comprising channel means cooperating with said support pad portions for defining moisture channels on said base portion on the opposite sides of said support pad portions from said attachment portion.

7. In the glass panel assembly of claim 6 said support pad portions and said attachment portion cooperating to define moisture channels on opposite sides of said attachment portion.

8. In the glass panel assembly of claim 1, said attachment element including a pair of spaced upstanding wall portions which cooperate to define a channel therebetween, said wall portions having opposed inwardly facing sides having spaced longitudinally extending grooves formed therein, said second fastening means comprising a plurality of threaded screws which are received in threaded engagement in said grooves.

9. In the glass panel assembly of claim 8, said attachment element further comprising a pair of flanges extending outwardly from said wall portions for supporting said attachment element on said attachment portion.

10. In the glass panel assembly of claim 1, said support pad portion being flexible for supporting a glass panel thereon in an angular disposition relative to said base portion.

11. In the glass panel assembly of claim 4, said attachment element including a pari of spaced upstanding wall portions which cooperate to define a channel therebetween, said wall portions having opposed inwardly facing sides having spaced longitudinally extending grooves formed therein, said second fastening means comprising a plurality of threaded screws which are received in threaded engagement in said grooves, said attachment element further comprising a pair of flanges extending outwardly from said wall portions for supporting said attachment element on said attachment portion and side support means extending outwardly and upwardly from one of said flanges for supporting said pressure cap on an adjacent one of said support portions.

12. In the glass panel assembly of claim 11, said support pad portions having upwardly facing support surfaces thereon, said side support means comprising a lower portion which extends upwardly and outwardly from said one of said flanges and along the upper surface of said adjacent one of said support pad portions and an upper portion which extends upwardly from said lower portion for supporting said pressure cap in upwardly spaced relation to said adjacent one of said support pad portions.

13. In the glass panel assembly of claim 12, said lower portion including a lower support section which rests on said adjacent one of said support pad portions, said upper portion including an upper support section which is disposed in spaced substantially parallel relation to said lower support section, said pressure cap being supported on said upper support section.

14. In the glass panel assembly of claim 12, said lower portion including a lower support section which rests on said adjacent one of said support pad portions, said upper support portion including a vertical section and a plurality of spaced substantially parallel upper support sections which extend from said vertical section, said upper support sections being disposed in spaced substantially parallel relation to said lower support section, said vertical section being adapted to be cut to a predetermined height to position a predetermined one of said upper sections in an uppermost position for supporting said pressure cap thereon whereby said side support means is adaptable for accommodating glass panels of various thicknesses:

15. A glass panel assembly for use on a supporting frame structure, the supporting frame structure comprising a vertical or inclined elongated first support element having a vertical or inclined first support surface and a horizontal second support element intersecting said first support element and having a second support surface which is parallel to the first support surface, said glass panel assembly comprising;

a) first and second elongated base plates made of a resilient elastomeric material received and supported on the first and second support elements, respectively, said base plates each including a base portion which is adapted to be received on and supported by the respective support element thereof so that each of said base portions extends longitudinally along the support surface of the respective support element thereof, each of said base plates further comprising an elongated longitudinally extending attachment portion extending upwardly from the respective base portion thereof when the base portion thereof is in an upwardly facing horizontal disposition and received on the support element and an elongated longitudinally extending support pad portion extending upwardly in outwardly spaced relation to the attachment portion thereof when the base portion thereof is in said horizontal disposition b) first and second rigid longitudinally extending attachment elements adapted to be received in coextensive relation on the attachment portions of said first and second base plates, respectively;

c) first attachment means for securing said first and second attached elements to the first and second roof support elements, respectively, through said first and second base plates, respectively;

d) a glass panel adapted to be received and supported on said support pad portions, said glass panel having first and second edges which are disposed in perpendicular relation to each other, said glass panel being adapted to be positioned so that said first and second edges are in spaced relation to said first and second attachment elements, respectively;

e) first and second elongated pressure caps each including an elongated rigid cap portion and an elongated resilient pressure pad made of an elastomeric material on the cap portion thereof, said first and second pressure caps being adapted to be received in assembled positions on said glass panel so that said glass panel is captured between the pressure pads thereof and the support pad portions of said first and second base plates, respectively; and f) second fastening means for securing said first and second pressure caps to said first and second attachment elements so that said pressure caps are maintained in the assembled positions thereof with the pressure pads of said first and second pressure caps in pressurized engagement with said glass adjacent said first and second edges, respectively.

16. In the glass panel assembly of claim 15, the attachment portion and the support pad portion of each of said base plates cooperating to form a first moisture channel therebetween, each of said base plates further comprising channel means defining a second moisture channel on the base portion thereof on the opposite side of the support pad portion thereof from the attachment portion thereof.

17. In the glass panel assembly of claim 16, the first and second moisture channels of said second base plate being in open communication with the second moisture channel of said first base plate for conducting moisture from said first and second channels in said second base plate to said first channel in said first base plate.

18. In the glass panel assembly of claim 16, the first and second moisture channels of said second base plate being at a higher elevation than and opening into the second moisture channel of said first base plate.

* * * * *